United States Patent [19]

Tschudin-Mahrer

[11] Patent Number: 4,621,731

[45] Date of Patent: Nov. 11, 1986

[54] FOAM SEALING STRIP PACKAGE

[75] Inventor: Rolf Tschudin-Mahrer, Lausen, Switzerland

[73] Assignee: Irbit Holding AG, Fribourg, Switzerland

[21] Appl. No.: 659,583

[22] Filed: Oct. 10, 1984

[30] Foreign Application Priority Data

Oct. 24, 1983 [DE] Fed. Rep. of Germany ... 8330528[U]

[51] Int. Cl.[4] ..... B65D 71/00

[52] U.S. Cl. ..... 206/83.5; 206/324; 206/451

[58] Field of Search ..... 206/83.5, 321, 324, 206/442, 449, 451, 495

[56] References Cited

U.S. PATENT DOCUMENTS

| | | | |
|---|---|---|---|
| 169,518 | 11/1875 | Brown | 206/83.5 |
| 784,011 | 2/1905 | Sheakley | 206/83.5 |
| 1,756,115 | 4/1930 | Daly | 206/451 |
| 1,887,226 | 11/1932 | Wunderlich | 206/83.5 |
| 3,282,415 | 11/1966 | Buff et al. | 206/83.5 |

FOREIGN PATENT DOCUMENTS

| | | | |
|---|---|---|---|
| 2364411 | 7/1974 | Fed. Rep. of Germany | 206/83.5 |
| 0172486 | 12/1921 | United Kingdom | 206/83.5 |

*Primary Examiner*—George E. Lowrance
*Assistant Examiner*—Jimmy G. Foster
*Attorney, Agent, or Firm*—Martin A. Farber

[57] ABSTRACT

A package of foam sealing strip of delayed rebound and of foam held in compressed state by the wall of the package. The wall of the package is formed of two flexurally rigid panels which protrude on both sides of the sealing strip and are held together by a plurality of hoops arranged spaced apart from each other.

5 Claims, 5 Drawing Figures

P

FOAM SEALING STRIP PACKAGE

FIELD AND BACKGROUND OF THE INVENTION

The invention relates to a package of foam sealing strip of delayed rebound and of foam held in compressed condition by the wall of the package.

One known form of supply is a coiled roll. In that case the package wall which holds the sealing strip in compressed condition consists of a support strip which is interleaved in the winding. The support strip is located on the adhesive-covered back of the sealing strip and is treated to repel adherence (to be non-adherable) on both its sides. Such sealing strips can be conveniently inserted into a joint which is to be closed as a result of the merely slow occurrence of rebound (expansion of the sealing strips when the compression is released). The rebound force results in a particularly favorable application of the sealing strip against the walls of the joint. Chloroparaffin is used as rebound delay agent. The keeping on hand of sealing strips of smaller cross section in compressed condition does not present any problem. It is only in the case of larger cross sections, for instance for the filling of joints of a width of a man's hand that it becomes difficult. Joints of this size are present in large structures, for instance on decks of parking garages. As a result of the layout which corresponds mostly to an open manner of construction, joints of considerable size are present due to temperatures of +40° C. to −40° C. With the sealing strip cross sections required here the coiled form with peripheral support layer mentioned above is no longer suitable.

The object of the present invention is to provide a package which is simple to produce and advantageous in use and which makes it possible to maintain even sealing strips for exceptionally large joints on hand ready for use, for instance strips whose final rebound height is several times the width of the strip.

SUMMARY OF THE INVENTION

Accordingly there is provided a package of foam sealing strip of delayed rebound and of foam held in compressed state by the wall of the package, wherein the wall of the package (V) is formed of two flexurally rigid panels (2') which protrude on both side of the sealing strip (1) and are held together by a plurality of hoops (5) arranged spaced apart from each other.

As a result of this development, a package of this type is obtained which is of particularly increased value in use: even sealing strips of large cross section can thus be held squeezed together between the rigid non-bendable panels, thus maintaining the state of compression. Even at room temperature one arrives at packaging pressures which change the rebound characteristic in such a manner that only a percentwise small rebound takes place initially for more than 12 hours, after which the rebound accelerates exponentially. Thus there is no time urgency to lay it and corrections are even still possible, for instance the removal of an inserted strip and the insertion of another sealing strip of a different size. The former sealing strip can then be again placed between the panels and secured. The final rebound height of the sealing strip corresponds to a multiple of its width. Thus large crevices can be reliably filled. One embodiment which is also advantageous in this respect and, in particular, avoids even a merely partial "swelling out" is when the sealing strip consists of several layers and the final rebound height of each layer is less than the width of the strip. The broad side of the layers rest against each other. They can also be impregnated faster. Storage and transportation are extremely space-saving. The sealing strip is ready for immediate use anywhere. It is merely necessary to loosen the ties which hold the panels together. Such ties may consist of ordinary commercial, for instance, metal tie bands. Due to the delayed rebound, special, generally complicated tying devices are not required. A simple hand tool by means of which the ends of the band are connected together with the use of an ordinary metal clamp is sufficient. The gradually occurring rebound leads to a more snugly applied, firm wrapping by the band. The substantial force of expansion which results from the rebound holds the sealing strip firmly against slippage, so that two panels arranged in the direction of compression are sufficient. By providing an adherence-repellent layer between the broad sides of the sealing strip and the corresponding inner surfaces of the panels the sealing strip can be easily released from its package; the impregnating agent has a certain adherent effect. If the panels consist of wood then, at the same time, one has building material which can be used for some other purpose or for firewood. An additional feature that the longitudinal side edges of the panels protrude beyond the broad sides of the sealing strip creates gripping spaces which result in easier handling of the package. In this way the longitudinal side edges can be dependably grasped by hand.

BRIEF DESCRIPTION OF THE DRAWINGS

The object of the invention is explained in further detail below with reference to one embodiment shown in the drawing, in which.

DETAILED DESCRIPTION OF THE PREFERRED EMBODIMENT

Figure 1:
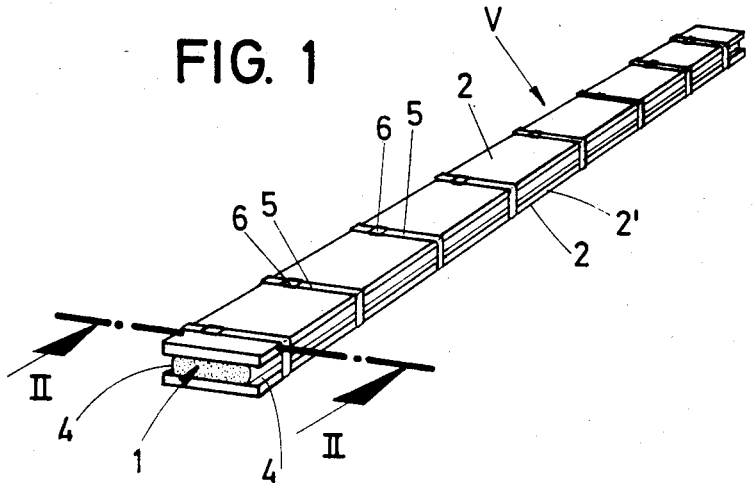
FIG. 1 is a perspective view of the package with foam sealing strip engaged therein.
Figure 2:
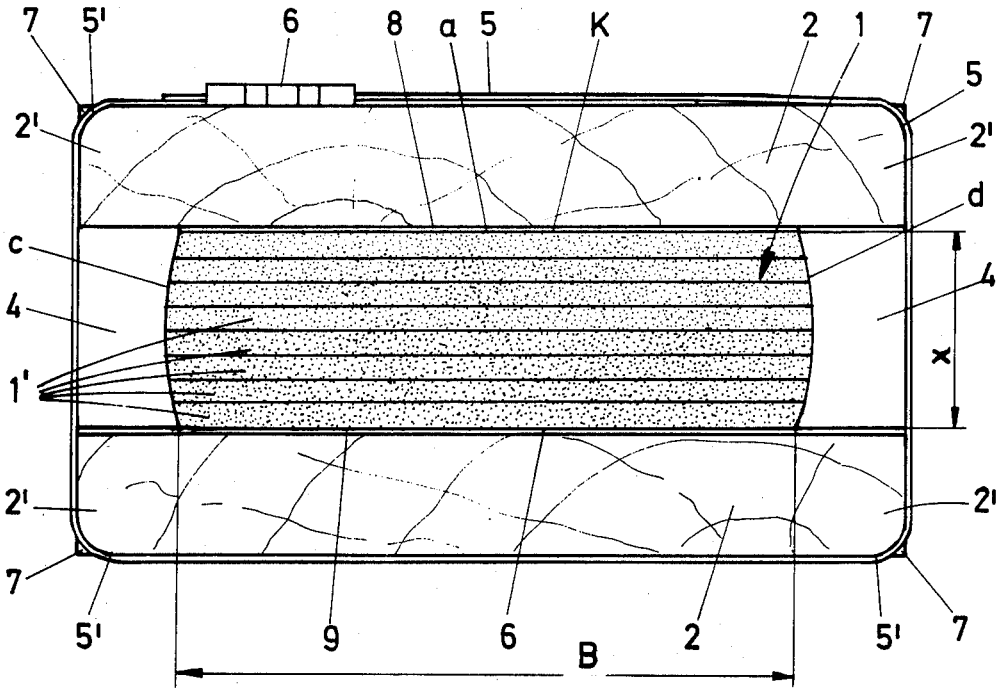
FIG. 2 is a section along the line II—II of FIG. 1, shown in approximately true size.
Figure 3A:
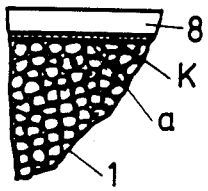
FIG. 3*a* shows an enlarged fragmentary view of this sealing strip in the region of its upper broad side.
Figure 3:
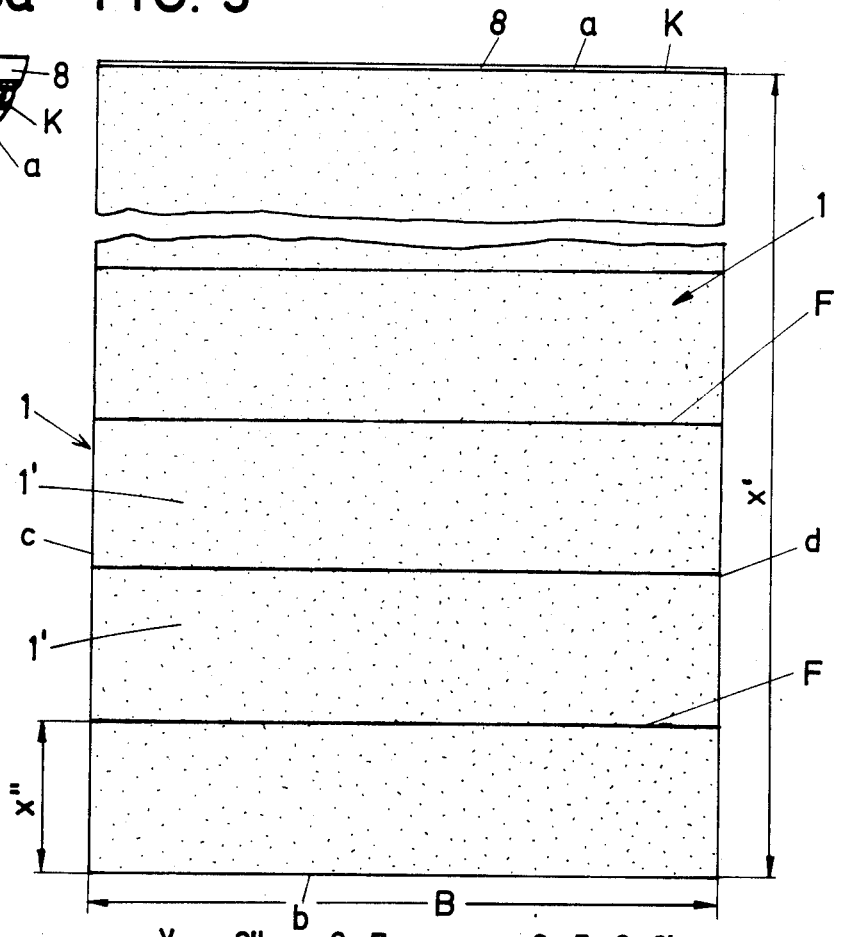
FIG. 3 is a broken away view of the sealing strip by itself, in its final rebound height.

The sealing strip 1, which is held in compressed state by a package V until its use, is made of foam. This foam is an open-pore foam. Its cell walls are lined with chloroparaffin by an impregnation process. In the compressed state the cell walls or parts thereof "stick" to each other, the webs of the foam structure being directed substantially transverse to the direction of compression P. With respect to its rebound, namely expansion when it is not under compression, there is a noticeable delay which, depending on the cross sectional size of the foam sealing strip and the degree of the package pressure, is on the order of several hours, and in particular more than 15 hours. The surrounding temperature, of course, also plays a part in this. The final rebound height x' may amount to seven times the compressed height x. After a greatly delayed initial phase the rebound proceeds increasingly faster due to the high package pressure which can be obtained. The compressed state is obtained by means of panels 2 which at the same time form the package V. They are rigid (not flexible) and constitute practically clamping jaws. Wood is preferably used for these panels. The length of such wooden boards is within the neighborhood of 2 or 3 meters. Of course, shorter lengths can also be selected. The width of the panels is 14 cm and their thickness 3 cm. The sealing strip 1 itself is of smaller width B so that the longitudinal side edges 2' of the panels 2 protrude beyond the broad sides a and b of the strip. In this way, with a symmetrical arrangement of the sealing strip 1 between the panels, there are longitudinally oriented free spaces 4 of equal width in front of the narrow sides c and d of the sealing strip 1. The final rebound height x' of the sealing strip 1 is a multiple of the strip width B. In the present case, the ratio is about 3:1.

The basic compressing position of the panels 1 is secured by hoops 5. They consist of steel bands, as is customary for packaging. The ends of the hoops 5 which wrap transversely around the panels 2 are connected together by means of clamps 6. These clamps are U-shaped holding elements which can be deformed into the shape of flat sleeves which on their narrow longitudinal sides are shaped in part by a tool (not shown in detail) transverse to the direction of wrapping, this with the simultaneous shaping of corresponding lengths of the hooping band 5. The ends are thus held fast, without slippage. The hooping can be effected with simple ordinary hand tools in view of the delay in rebound. For this purpose, the precompressed sealing strip is simply placed between the two panels insert 2. Sufficient time remains to apply all hoops 5 in proper manner. Any play in the hooping is taken up by the rebound which gradually takes place. In this connection, the portions 5' of the hoops 5 which are close to the corners dig in, rounding these regions. There are thus formed notches 7 which correspond to the width of the hoop band 5 as a result of which the hoops 5 are held fast against displacement even in longitudinal direction.

The unpacking is effected entirely without danger since no spontaneous sudden rebound force is present. For this purpose it is merely necessary to cut the hoops 5. As a result of the free spaces 4 left on the narrow longitudinal sides of the package V, this can be conveniently effected on either side. These free spaces also contribute to easier handling, for instance easier grasping of the package V. Thus the longitudinal side edges 2' or either one or the other panel 2 can be gripped, the ends of the fingers resting in the free spaces 4.

In case of extreme thicknesses of the sealing strip, the strip may be formed of a plurality of layers 1'. In the present example, 8 individual strips of identical dimensions are superimposed on each other. The connecting joints are indicated by the reference letter F. They can be developed as adhesive joints. On the other hand, however, the impregnating agent by itself results in a certain adherence, which is sufficient. The final rebound height of each of the layers 1' of such a sandwiched strip is less than the width B of the strip. The ratio is about 1:3.

Between the broad sides a and b of the sealing strip and the corresponding inner surfaces of each panel 2 there is an adherent-repelling layer 8 and 9 respectively. The lower layer 9 extends over the entire width of the panel. It consists, for instance, of so-called wax paper. It is fastened by means of a pressure-sensitive adhesive to the lower panel 2. The back side which faces the sealing panel is made adhesive-repellent (non-adhering) by the use of silicone. The upper layer 8 consists of a backing as backing paper such as already used in the production of the sealing strip 1 and therefore already present. Such a layer serves as a protective strip for a layer of pressure-sensitive adhesive K. After peeling off the protective strip this side can enter into an adhesive bond with one wall of a joint which is to be filled. On the other broad side the panel can initially remain adhesively bound to the sealing strip so that this panel serves as insertion tool. By using the panel as a lever from the rear, the adhesive layer K can be pressed firmly against the corresponding wall of the joint. This panel can then easily be removed from the joint due to the non-adhering layer 9. The attached sealing strip rebounds, closing the joint.

Figure 4:
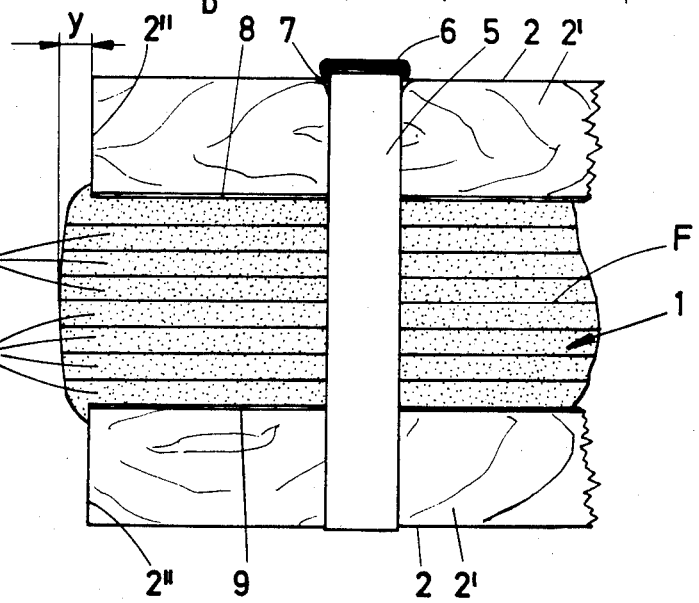
FIG. 4 shows the end region of the package, in side view.

As can be noted from FIG. 4, the end face of the sealing strip 1 (as well as the other end face) protrudes a slight distance y beyond the end faces 2'' of the panels 2. Such a protrusion can be utilized as impact-dampening means. On the other hand, however, it is also favorable to cut off this protruding section, using the ends 2'' as a cutting template. This freshly cut surface permits a clean connection to the end of the next following sealing strip, obtained with utilization of the impregnating agent, which has a certain tackiness. Since the sealing strip is not compressed in its longitudinal direction, no lip-like bulging takes place on the visible side of the filling of the joint.

All new features mentioned in the specification and shown in the drawing are essential to the invention even if they have not been expressly mentioned in the claims.

I claim:

1. A package of foam sealing strip, comprising foam sealing strip of delayed rebound, two unbendable panels sandwiching the sealing strip therebetween, said panels protrude on both side of the sealing strip, a plurality of removable hoops arranged spaced apart from each other hold the panels which in turn hold the sealing strip therebetween in compressed state, and non-adherable layers respectively are disposed between broad sides respectively of the sealing strip and corresponding inner surfaces of the panels, whereby upon release of said removable hoops the foam sealing strip does not exhibit noticeable rebound for at least 12 hours.

2. The package according to claim 1, wherein said sealing strip, in a condition with the hoops and panels removed and without forces on the strip, has a final rebound height which is a multiple of the lateral width of the strip.

3. The package according to claim 2, wherein said sealing strip comprises a plurality of layers and the final rebound height of each layer is less than the lateral width of the strip.

4. The package according to claim 1, wherein said panels are made of wood.

5. The package according to claim 1, wherein longitudinal side edges of the panels protrude beyond broad sides of the sealing strip, said broad sides being held adjacent corresponding inner surfaces of the panels.

* * * * *